US011441360B2

(12) United States Patent
Bailey et al.

(10) Patent No.: US 11,441,360 B2
(45) Date of Patent: Sep. 13, 2022

(54) DOWNHOLE ECCENTRIC REAMER TOOL AND RELATED SYSTEMS AND METHODS

(71) Applicant: National Oilwell Vareo, L.P., Houston, TX (US)

(72) Inventors: Michael James Bailey, Rockhampton (GB); John Russell Lockley, Tomball, TX (US); Gordon Wayne Jones, Conroe, TX (US); Roger Silva, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 28 days.

(21) Appl. No.: 17/125,786

(22) Filed: Dec. 17, 2020

(65) Prior Publication Data

US 2022/0195808 A1 Jun. 23, 2022

(51) Int. Cl.
*E21B 10/26* (2006.01)
*E21B 3/00* (2006.01)

(52) U.S. Cl.
CPC ..... *E21B 10/26* (2013.01); *E21B 3/00* (2013.01)

(58) Field of Classification Search
CPC ..... E21B 10/26; E21B 10/43; E21B 17/1078; E21B 17/28; E21B 17/10; E21B 17/201; E21B 3/00
See application file for complete search history.

(56) References Cited

U.S. PATENT DOCUMENTS 2,548,724 A 4/1951 Jones
3,237,705 A 3/1966 Williams, Jr.
3,848,683 A 11/1974 Persson
4,739,843 A 4/1988 Burton
5,341,888 A 8/1994 Deschutter
5,992,548 A 11/1999 Silva et al.
6,401,820 B1 6/2002 Kirk et al.
(Continued)

FOREIGN PATENT DOCUMENTS

CN 1711404 A 12/2005
CN 1784533 A 6/2006
(Continued)

OTHER PUBLICATIONS

ReedHycalog Flyer entitled "Concentric and Eccentric String Hole Opening Solutions," dated 2006 (3 p.).
(Continued)

*Primary Examiner* — Caroline N Butcher
(74) *Attorney, Agent, or Firm* — Conley Rose, P.C.

(57) ABSTRACT

Reaming tools for reaming a borehole and related systems and methods are described herein. In an embodiment, the tool includes a body having a central axis, and a plurality of blades. Each of the plurality of blades includes an uphole section that extends in a first helical direction, a downhole section that extends in a second helical direction that is opposite the first helical direction, and an arcuate central section that continuously extends from the uphole section to the downhole section. The plurality of blades are eccentric about the central axis such that the reaming tool is configured to pass axially through a first diameter and is configured to ream a borehole to a second diameter that is greater than the first diameter when the tool is rotated about the central axis in a cutting direction.

17 Claims, 7 Drawing Sheets

(56) References Cited

U.S. PATENT DOCUMENTS

| | | | | |
|---|---|---|---|---|
| 6,913,098 | B2 | 7/2005 | Fielder et al. | |
| 8,162,081 | B2 | 4/2012 | Ballard et al. | |
| 8,813,877 | B1 | 8/2014 | Short et al. | |
| 10,316,595 | B2 * | 6/2019 | Svendsen | E21B 17/05 |
| 2001/0004536 | A1 | 6/2001 | Ikegami | |
| 2002/0092378 | A1 | 7/2002 | Fielder et al. | |
| 2002/0125047 | A1 | 9/2002 | Beaton | |
| 2004/0099448 | A1 | 5/2004 | Fielder et al. | |
| 2005/0092526 | A1 | 5/2005 | Fielder et al. | |
| 2007/0005316 | A1 | 1/2007 | Paez | |
| 2008/0047754 | A1 | 2/2008 | Evans et al. | |
| 2010/0051349 | A1 | 3/2010 | Ballard et al. | |
| 2010/0078216 | A1 | 4/2010 | Radford et al. | |
| 2010/0089659 | A1 | 4/2010 | Chafai | |
| 2010/0096189 | A1 | 4/2010 | Salzer, III et al. | |
| 2010/0326738 | A1 | 12/2010 | Boulet | |
| 2011/0048803 | A1 * | 3/2011 | Robson | E21B 17/10 175/323 |
| 2012/0255786 | A1 | 10/2012 | Isenhour | |
| 2013/0161099 | A1 * | 6/2013 | Silva | E21B 10/26 175/57 |

FOREIGN PATENT DOCUMENTS

| | | | |
|---|---|---|---|
| CN | 101052779 | A | 10/2007 |
| CN | 201034015 | Y | 3/2008 |
| CN | 201436365 | U | 4/2010 |
| GB | 2441214 | A | 2/2008 |
| GB | 2464191 | A | 4/2010 |
| WO | 2007133739 | A2 | 11/2007 |
| WO | 2010044767 | A1 | 4/2010 |

OTHER PUBLICATIONS

PCT/US2012/071808 International Search Report and Written Opinion dated Apr. 9, 2014 (20 p.).

Chinese Patent Application No. 201280065251.7 Office Action dated Jun. 24, 2015 (11 pages).

Canadian Patent Application No. 2,859,892 Office Action dated Aug. 24, 2015 (4 pages).

United Kingdom Patent Application No. 1410357.6 Search and Examination Report dated Nov. 10, 2015 (3 pages).

* cited by examiner

DOWNHOLE ECCENTRIC REAMER TOOL AND RELATED SYSTEMS AND METHODS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

To form a subterranean borehole (e.g., subterranean hydrocarbons and/or other resources), an earth-boring drill bit may be connected to the lower end of a drillstring and then rotated via the drillstring, a downhole motor, or by both. With weight-on-bit (WOB) applied, the rotating drill bit may engage a subterranean formation and thereby form or lengthen a borehole along a predetermined path.

During drilling operations, costs are generally proportional to the length of time it takes to drill the borehole to the desired depth and location. The time required to drill the borehole, in turn, is greatly affected by the number of times downhole tools must be changed or added to the drillstring in order to complete the borehole. This is the case because each time a tool is changed or added, the entire drillstring, which may be miles long, must be retrieved from the borehole, section-by-section. Once the drill string has been retrieved and the tool changed or added, the drillstring must be constructed section-by-section and lowered back into the borehole. This process, known as a "trip" of the drillstring, requires considerable time, effort, and expense. Thus, it is desirable to reduce the number of times the drillstring must be tripped to complete the borehole.

In addition, during drilling operations, achieving good borehole quality is also desirable. However, directional corrections that are made during drilling to keep the drill bit on the predetermined path may result in the formation of ledges and/or sharp corners in the borehole that interfere with the passage of subsequent tools therethrough. A reamer can be used to remove these ledges and sharp corners, and thereby improve the overall borehole quality.

BRIEF SUMMARY

Some embodiments disclosed herein are directed to reaming tools for reaming a borehole. In some embodiments, the reaming tool comprises a tubular body having a central axis, and a plurality of blades circumferentially spaced along the tubular body. Each of the plurality of blades comprises an uphole section that extends in a first helical direction about the central axis along the tubular body, a downhole section that extends in a second helical direction about the central axis along the tubular body, wherein the second helical direction is opposite the first helical direction, and an arcuate central section that continuously extends from the uphole section to the downhole section along the tubular body. The plurality of blades are eccentric about the central axis such that the reaming tool is configured to pass axially through a first diameter and is configured to ream a borehole to a second diameter that is greater than the first diameter when the tool is rotated about the central axis in a cutting direction.

Some embodiments disclosed herein are directed to systems for drilling a borehole in an earthen formation. In some embodiments, the system includes a drillstring having a central axis, an uphole end, and a downhole end, and a drill bit disposed at the downhole end of the drillstring coaxially aligned with the drillstring, wherein the drill bit is configured to rotate about the central axis in a cutting direction to drill the borehole. In addition, the system includes a reaming tool coupled to the drillstring such that the reaming tool is positioned between the drill bit and the uphole end of the drillstring along the central axis. The reaming tool includes a tubular body, and a plurality of blades circumferentially spaced along the tubular body. Each of the plurality of blades includes an uphole section that extends in a first helical direction about the central axis along the tubular body, a downhole section that extends in a second helical direction about the central axis along the tubular body, wherein the second helical direction is opposite the first helical direction, and an arcuate central section that continuously extends from the uphole section to the downhole section along the tubular body. The plurality of blades are eccentric about the central axis such that the reaming tool is configured to pass axially through a first diameter and is configured to ream a borehole to a second diameter that is greater than the first diameter when the reaming tool is rotated about the central axis in a cutting direction.

Some embodiments are directed to methods for drilling a borehole. In some embodiments, the method includes (a) coupling a drill bit to a lower end of a drillstring, and (b) coupling a reaming tool to the drillstring between the drill bit and an uphole end of the drillstring. The reaming tool includes a tubular body having a central axis and a plurality of blades circumferentially spaced along the tubular body. Each of the plurality of blades includes an uphole section that extends in a first helical direction about the central axis along the tubular body, a downhole section that extends in a second helical direction about the central axis along the tubular body, wherein the second helical direction is opposite the first helical direction, and an arcuate central section that continuously extends from the uphole section to the downhole section along the tubular body. The plurality of blades define a first outer diameter for the reaming tool. In addition, the method includes (c) lowering the reamer tool section through a casing having an inner diameter that is greater than or equal to the first outer diameter of the reaming tool. Further, the method includes (d) rotating the drill bit and the remaining tool in a cutting direction about the central axis after (c), and (e) reaming the borehole with the plurality of blades of the reaming tool during (c) to a reaming diameter that is greater than the first outer diameter of the reaming tool and the inner diameter of the casing.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
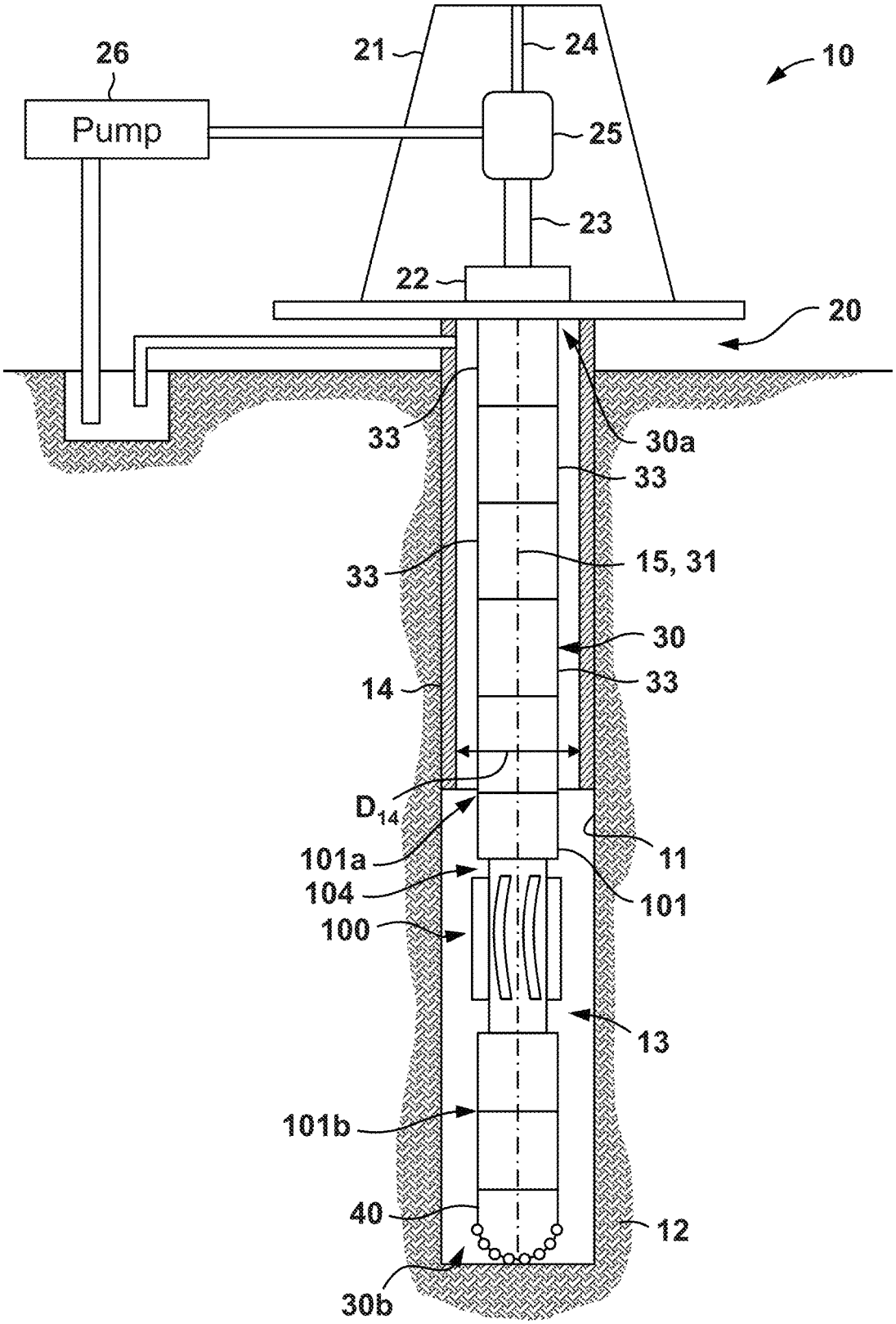
FIG. 1 is a schematic view of an embodiment of a drilling system according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

As previously described, when drilling a subterranean borehole, a reamer may be used to remove these ledges and sharp corners, and thereby improve the overall borehole quality. For a non-expanding reamer, the diameter of the reamer is limited by the diameter of the casing in the borehole that the drill bit and reamer must pass through. If a concentric non-expanding reamer having the same or smaller diameter than the drill bit is used with the drill bit, the reamer will generally follow the path of the drill bit and may not be effective in removing the ledges and/or sharp corners.

By contrast, an eccentric reamer may ream the borehole to a diameter that is larger than the diameter of the drill bit and is typically effective in removing ledges and sharp corners. In many cases, an eccentric reamer may not be utilized with a drill bit when drilling a new section of the borehole for fear of causing damage to the casing and/or cutter elements on the reamer blades. Consequently, after drilling a new section of the borehole, the driller will make a dedicated trip out of the borehole to couple an eccentric reamer to the drill bit and then trip back into the borehole with the drill bit and reamer in order to ream the previously created section of borehole. Alternately, the driller may complete drilling of the new section with the drill bit alone, trip out of the borehole, and then return into the borehole with the eccentric reamer to ream the hole. However, in both cases, an additional trip of the drillstring is required to ream the borehole, which as previously described above, adds considerable cost to the borehole drilling operation.

Accordingly, embodiments disclosed herein include reaming tools for reaming a borehole. In some embodiments, the reaming tools may be eccentric so that they have a pass through diameter that is smaller than a diameter that is reamed when the reaming tool is rotated in a cutting direction. In addition, in some embodiments, the reaming tools may be rotated within a casing without engaging or damaging an inner casing wall, but may ream a borehole to a diameter larger than the inner diameter of the casing. Further details of the reaming tools of the disclosed embodiments are provided below with reference to the drawings.

Referring now to FIG. 1, an embodiment of a drilling system 10 is schematically shown. In this embodiment, drilling system 10 includes a drilling rig 20 positioned over a borehole 11 penetrating a subsurface formation 12, a casing 14 extending from the surface into the upper portion of borehole 11, and a drillstring 30 suspended in borehole 11 from a derrick 21 of rig 20. Casing 14 has a central or longitudinal axis 15 and an inner diameter $D_{14}$. Drillstring 30 has a central or longitudinal axis 31, a first or uphole end 30*a* coupled to derrick 21, and a second or downhole end 30*b* opposite end 30*a*. In addition, drillstring 30 includes a drill bit 40 at downhole end 30*b*, a downhole reaming tool 100, axially adjacent bit 40, and a plurality of pipe joints 33 extending from cutting tool 100 to uphole end 30*a*. Pipe joints 33 are connected end-to-end, and tool 100 is connected end-to-end with the lowermost pipe joint 33 and bit 40. While not specifically shown, a bottomhole assembly (BHA) can be disposed in drillstring 30 proximal the bit 40 and reaming tool 100 (e.g., axially uphole or both the drill bit 40 and reaming tool 100 in some embodiments).

In the embodiment of FIG. 1, drill bit 40 is rotated by rotating drillstring 30 from the surface. In particular, drillstring 30 is rotated by a rotary table 22 that engages a kelly 23 coupled to uphole end 30*a* of drillstring 30. Kelly 23, and hence drillstring 30, is suspended from a hook 24 attached to a traveling block (not shown) with a rotary swivel 25 which permits rotation of drillstring 30 relative to derrick 21.

Although drill bit 40 is rotated from the surface with drillstring 30 in this embodiment, in general, the drill bit 40 can be rotated with a rotary table or a top drive, rotated by a downhole mud motor disposed in the BHA (not shown), or combinations thereof (e.g., rotated by both rotary table via the drillstring and the mud motor, rotated by a top drive and the mud motor, etc.). For example, rotation via a downhole motor may be employed to supplement the rotational power of a rotary table 22, if required, and/or to effect changes in the drilling process. Thus, it should be appreciated that the various aspects disclosed herein are adapted for employment in each of these drilling configurations and are not limited to conventional rotary drilling operations.

During drilling operations, a mud pump 26, which is positioned at the surface, pumps drilling fluid or mud down the interior of drillstring 30 via a port in swivel 25. The drilling fluid exits drillstring 30 through ports or nozzles in the face of drill bit 40, and then circulates back to the surface through the annulus 13 between drillstring 30 and the sidewall of borehole 11. The drilling fluid functions to lubricate and cool drill bit 40, and carry formation cuttings to the surface.

Referring now to FIGS. 2-5, an embodiment of reaming tool 100 is shown. As will be described in more detail below, reaming tool 100 functions to ream borehole 11 during drilling operations. In this embodiment, reaming tool 100 includes an elongate tubular body 101, and a plurality of blades 110, 120.

Tubular body 101 has a central or longitudinal axis 105 that is coincident with drillstring axis 31 (not shown in FIGS. 2-4, but see FIG. 1), a first or uphole end 101*a*, a second or downhole end 101*b* opposite the uphole end 101*a*, a generally cylindrical outer surface 102 extending axially between ends 101*a*, 101*b*, and an inner throughbore 103 extending axially between ends 101*a*, 101*b*. Throughbore 103 allows for the passage of drilling fluid through tool 100 in route to bit 40 (not shown in FIGS. 2-4, but see FIG. 1). During drilling operations, tool 100 is rotated about axis 105 in a cutting direction 106.

Outer surface 102 of body 101 includes an annular cylindrical recess 104 axially disposed between the ends 101*a*, 101*b*. Thus, the diameter of outer surface 102 is reduced within recess 104. In this embodiment, recess 104 is generally axially equidistant from each ends 101*a*, 101*b*; however, in other embodiments recess 104 may be axially shifted closer to one of the ends 101*a*, 101*b*. Ends 101*a*, 101*b* may comprise any suitable connection mechanisms/structures for coupling the reaming tool 100 within the drillstring 30 (see e.g., FIG. 1). For instance, in some embodiments downhole end 101*b* may comprise a male threaded connector (e.g., a threaded pin connector) that connects to a mating female box-end of an adjacent tubular or component (e.g., drill bit 40, a pipe joint 33, etc.), and uphole end 101*a* may comprises a female threaded connector (e.g., a threaded box connector) that connects to a mating threaded male connector on an adjacent tubular or component (e.g., a component of the BHA, a pipe joint 33, etc.).

Referring still to FIGS. 2-5, the plurality of blades 110, 120 are circumferentially spaced about the central axis 105 along the tubular body 101 within recess 104. In some embodiments, the plurality of blades 110, 120 are evenly circumferentially spaced about axis 105 within recess 104. Each of the blades 110, 120 extend radially outward from recess 104, and may be integrally formed as a part of tool body 101. In other words, blades 110, 120 and body 101 are a monolithic, single-piece body. As will be described in more detail below, the plurality of blades 110 comprises one or more first or reaming blades 110 that configured to cut and shear the sidewall of borehole 11, and one or more second or stabilizing blades 120 that are configured to function as stabilizing bearing surfaces during rotation of the reaming tool 110 inside of the casing 14 and/or the borehole more generally.

Figure 6:
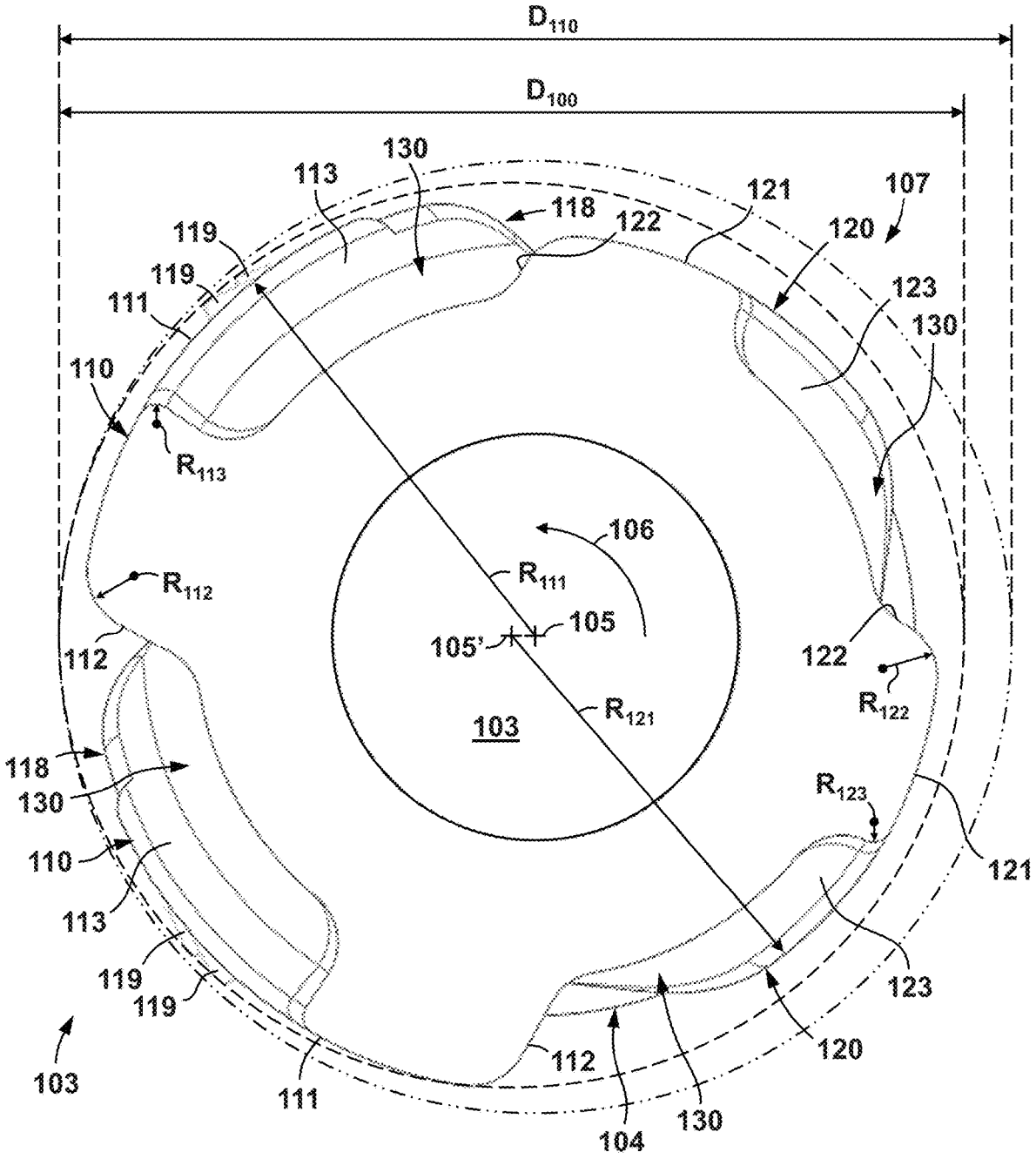
FIG. 6 is a cross-sectional view taken along section 6-6 shown in FIGS. 2 and 4.

Referring briefly to FIG. 6 in this embodiment, the reaming tool 100 comprises a total of four blades 110, 120—two reaming blades 110 and two stabilizing blades 120. The reaming blades 110 are positioned on a first side 103 of tubular body 101, and the stabilizing blades 120 are positioned on a second side 107 of tubular body 101. The first side 103 may be radially opposite the second side 107 about the central axis 105, such that the first side 103 is spaced approximately 180° from the second side 107 about axis 105. In some embodiments, the number of reaming blades 110 and stabilizing blades 120 may be higher or lower than that shown in FIG. 6. For instance, in some embodiments, the reaming tool 100 may include more than four blades (e.g., such as 5, 6, 7, etc.), and may include any suitable distribution of reaming blades 110 and stabilizing blades 120.

Figure 3:
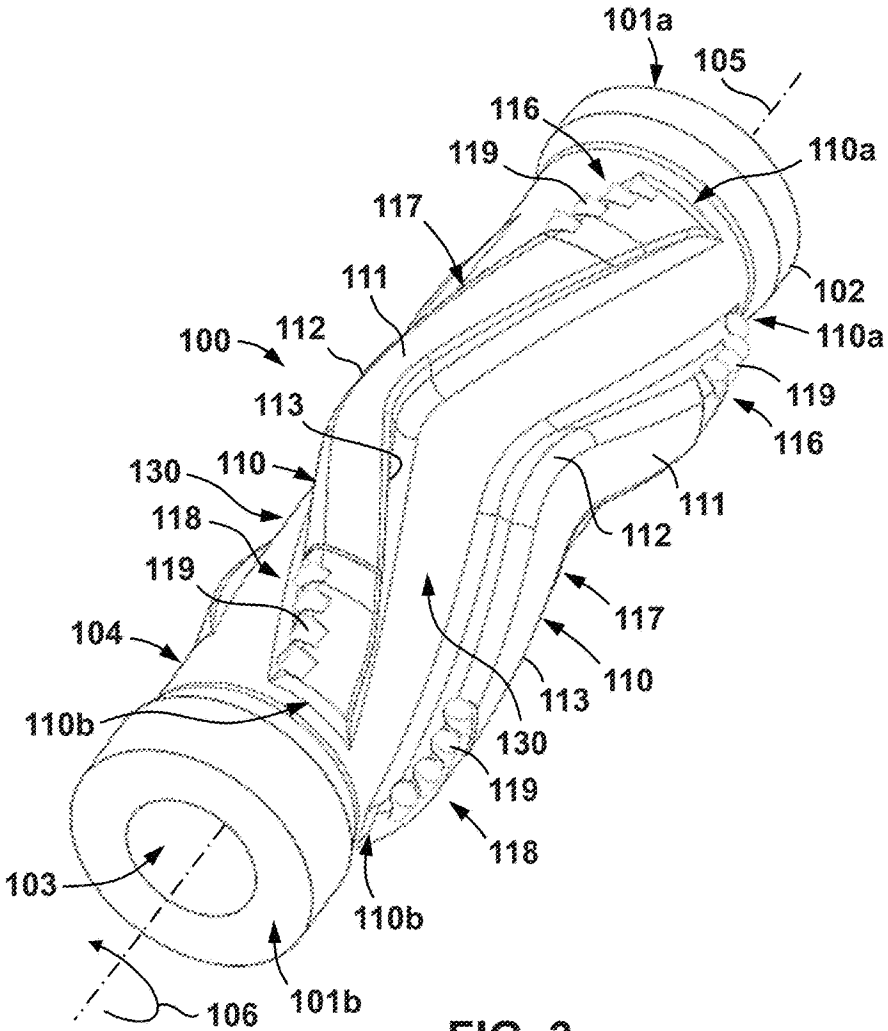
FIG. 3 is a perspective view of the first side of the reaming tool of FIG. 2 according to some embodiments.
Figure 2:
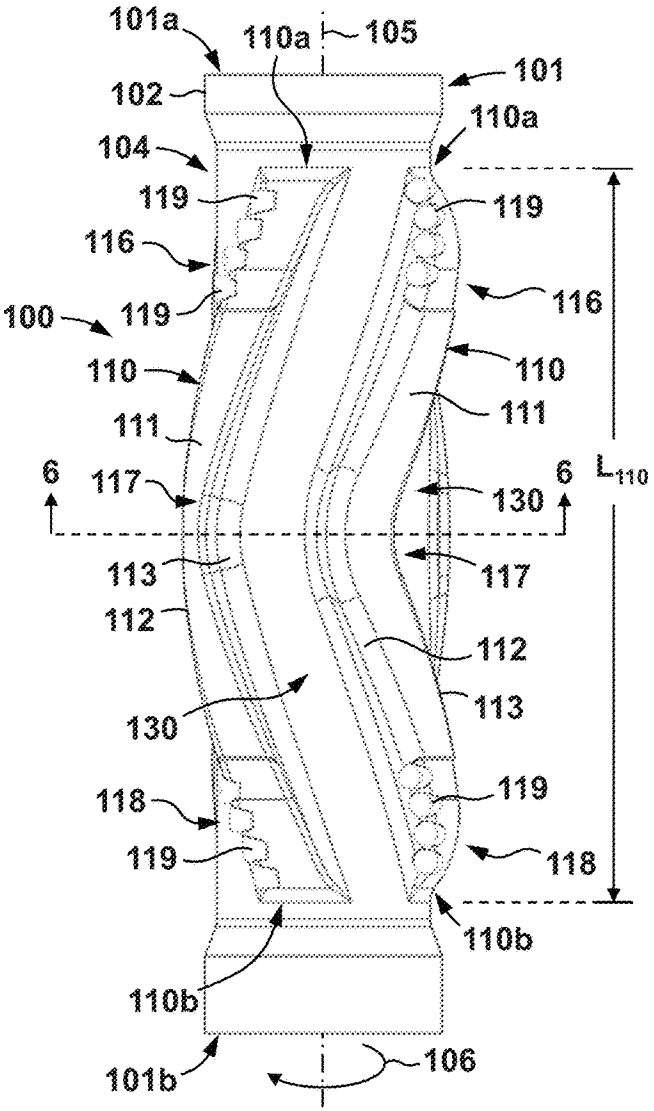
FIG. 2 is a side view of a first side of a reaming tool for use within the system of FIG. 1 according to some embodiments.

Referring specifically to FIGS. 2 and 3, each of the reaming blades 110 has a first or uphole end 110*a*, a second or downhole end 110*b*, a formation-facing surface 111, a forward-facing or leading surface 112, and a generally rear-facing or trailing surface 113. Each surface 111, 112, 113 extends between ends 110*a*, 110*b* of the corresponding blade 110. Surfaces 111 are radially spaced from outer surface 102 and face the sidewall of borehole 11 during drilling operations (see e.g., FIG. 1), and surfaces 112, 113 extend generally radially from outer surface 102 to surface 111. Surfaces 112 are termed "forward-facing" or "leading" as they lead the corresponding blade 110 relative to the cutting direction of rotation 106; and surfaces 113 are termed "rear-facing" or "trailing" as they trail the corresponding blade 110 relative to the cutting direction of rotation 106.

Each of the reaming blades 110 comprises an uphole section 116 extending from the uphole end 110*a*, a downhole section 118 extending from the downhole end 110*b*, and an arcuate central section 117 that continuously extends between the uphole section 116 and the downhole section 118. The uphole section 116 and downhole section 118 of each blade 110 extend helically in opposite directions about axis 105 along body 101 (e.g., within recess 104). In particular, uphole section 116 extends helically about axis 105 in a first helical direction, while downhole section 1187 extends helically about axis 105 in a second helical direction that is opposite the first direction.

The arcuate central section 117 continuously joins the uphole section 116 and downhole section 118, so that each blade 110 has a generally boomerang or chevron shape. The blades 110 are oriented along tool body 101 so that the arcuate central section 117 leads the uphole section 116 and downhole section 118 with respect to the cutting direction 106. As a result, the leading surface 112 of each blade 110 is convexly curved and trailing surface 113 is concavely curved when moving axially along axis 105 of body 101.

Referring now to FIGS. 2, 3, and 6, formation facing surface 111 of each blade 110 is disposed at an outer radius $R_{111}$ measured radially from axis 105 (see e.g., FIG. 6). Blades 110 taper or decline radially inward when moving from arcuate central section 117 toward uphole end 110*a* and downhole end 110*b*. Thus, radius $R_{111}$ of formation facing surface 111 decreases from a relative maximum at arcuate central section 117 along each of the uphole section 116 and downhole section 118 toward uphole end 110*a* and downhole end 110*b*, respectively. For purposes of clarity and further explanation, the maximum radius $R_{111}$ of formation facing surface 111 of each blade 110 (e.g., the maximum radius within the uphole section 116, downhole section 118 and along the arcuate central section 117) is referred to herein as $R_{111\ max}$.

Referring again to FIGS. 2 and 3, the uphole section 116 and the downhole section 118 of each blade 110 includes a plurality of cutter elements 119 mounted to the formation facing surface 111. In particular, with the uphole section 116 and downhole section 118 of each blade 110, cutter elements 119 are arranged adjacent one another in row along the leading edge 112 (i.e., along the intersection of surfaces 111, 112).

In general, each cutter element 119 can be any suitable type of cutter element known in the art. In this embodiment, each cutter element 119 comprises an elongate cylindrical tungsten carbide support member and a hard polycrystalline diamond (PCD) cutting layer bonded to the end of the support member. The support member of each cutter element 119 is received and secured in a pocket formed in surface 111 of the corresponding blade 110 leaving the cutting layer exposed. The cutting faces of the cutter elements 119 may be any suitable shape such as, for instance, planar, convex, concave, or a combination thereof.

The cutting face of each cutter element 119 extends to an extension height measured radially from the corresponding formation-facing surface 111. In this embodiment, the extension height of the cutting face of each cutter element 119 is the same for each of the blades 110. However, since the radii $R_{111}$ of formation facing surfaces 141 of blades 111 decrease moving from arcuate central section toward the uphole end 110*a* and downhole end 110*b*, the radii to which the cutting faces of the cutter elements 119 mounted to blades 110 extend relative to axis 105 progressively decrease moving toward uphole end 110*a* and downhole end 110*b*. In some embodiments, the cutting face of the lowermost cutter element 119 along the uphole section 116 and the uppermost cutter element 119 along the downhole section 118 extend to a radius equal to radius $R_{111\ max}$, with the cutting faces of the remaining cutter elements 119 mounted within the uphole section 116 and downhole section 118 of each blade 110 extending to radii that progressively decrease moving towards uphole end 110*a* and downhole end 110*b*, respectively.

Referring now to FIG. 6, the transition between the formation facing surface 111 and leading surface 112, and between the formation facing surface 111 and trailing surface 113 of each blade 110 may be convexly curved or radiused when moving along the circumferential perimeter of the reaming tool 100. In particular, in some embodiments, the radius $R_{112}$ of the transition between the leading surface 112 and the formation facing surface 111 may be larger than the radius $R_{113}$ of the transition between the formation facing surface 111 and the trailing surface 113. In some embodiments, the radius $R_{113}$ may be less than the radius $R_{112}$. For instance, in some embodiments, the radius $R_{113}$ may be about one third (⅓) of the radius $R_{112}$. In some embodiments, the radius $R_{112}$ may be substantially equal to the radius $R_{113}$. In some embodiments, the radius $R_{112}$ may be greater than or equal to about 0.3 inches (in), and the radius $R_{113}$ may less than or equal to about 0.3 in. Thus, in some embodiments, for each blade 110, the transition between the leading surface 112 and the formation facing surface 111 may be more gradual than the transition between the trailing surface 113 and the formation facing surface 111. Without being limited to this or any other theory, a less abrupt transition between the formation facing surface 111 and the leading surface 112 (e.g., radius $R_{112}$) may allow for more gradual contact initiation between the blade 110 and the borehole wall 11 (or casing 114) as reaming tool 100 is rotated, so that stresses imparted to the reaming tool 100 (e.g., via blades 110) may be reduced during operations.

Figure 5:
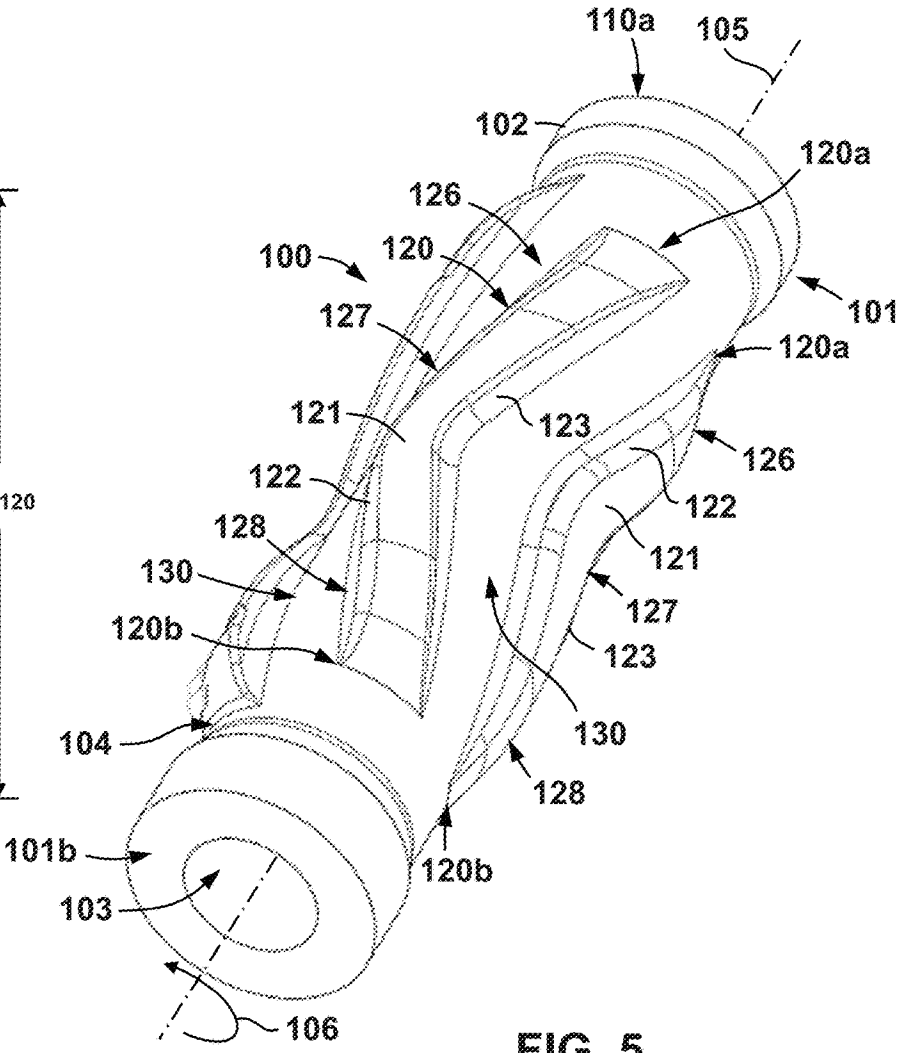
FIG. 5 is a perspective view of the second side of the remaining tool of FIG. 2 according to some embodiments.
Figure 4:
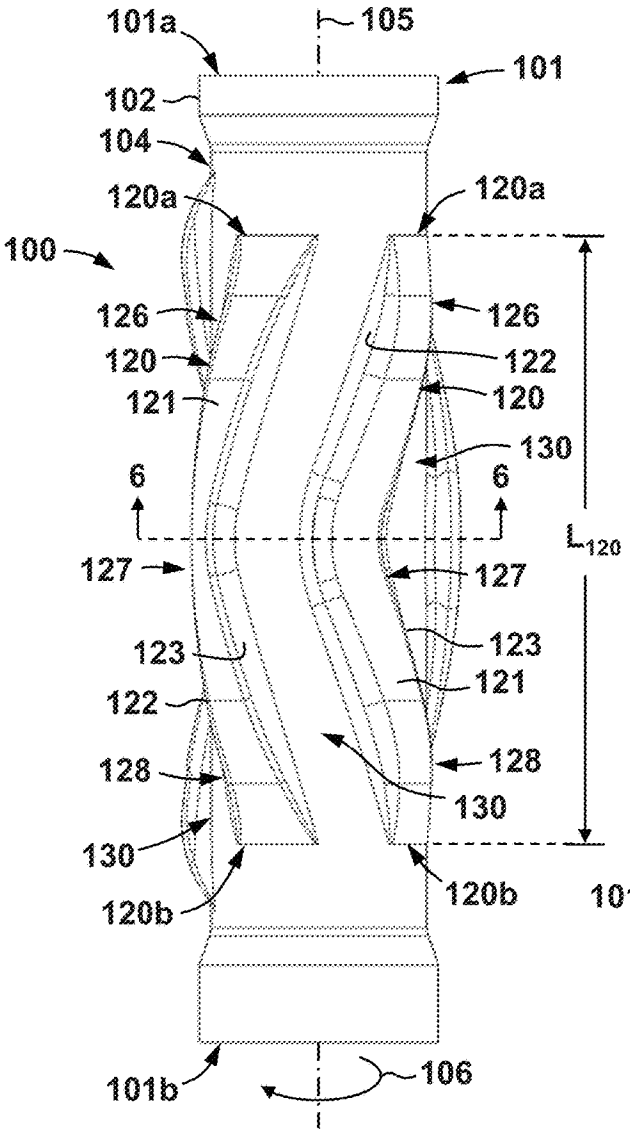
FIG. 4 is a side view of a second side of a reaming tool of FIG. 2 according to some embodiments.

Referring specifically to FIGS. 4 and 5, each of the stabilizing blades 120 has a first or uphole end 120*a*, a second or downhole end 120*b*, a formation-facing surface 121, a forward-facing or leading surface 122, and a generally rear-facing or trailing surface 123. Each surface 121, 122, 123 extends between ends 120*a*, 120*b* of the corresponding blade 120. Surfaces 121 are radially spaced from outer surface 102 and face the sidewall of borehole 11 during drilling operations (see e.g., FIG. 1), and surfaces 122, 123 extend generally radially from outer surface 102 to surface 121. Surfaces 122 are termed "forward-facing" or "leading" as they lead the corresponding blade 120 relative to the cutting direction of rotation 106; and surfaces 123 are termed "rear-facing" or "trailing" as they trail the corresponding blade 110 relative to the cutting direction of rotation 106.

Each of the stabilizing blades 120 comprises an uphole section 126 extending from the uphole end 120*a*, a downhole section 128 extending from the downhole end 120*b*, and an arcuate central section 127 that continuously extends between the uphole section 126 and the downhole section 128. The uphole section 126 and downhole section 128 of each blade 120 extend helically in opposite directions about axis 105 along body 101. In particular, uphole section 126 extends helically about axis 105 in the first helical direction, while downhole section 128 extends helically about axis 105 in a second helical direction that is opposite the first direction. Thus, in some embodiments, the uphole sections 126 of stabilizing blades 120 extend in parallel to the uphole sections 116 of the reaming blades 110, and the downhole sections 128 of stabilizing blades 120 may extend in parallel to the downhole sections 118 of the reaming blades 110.

The arcuate central section 127 continuously joins the uphole section 126 and downhole section 128, so that each blade 120 has a generally boomerang or chevron shape. The blades 120 are oriented along tool body 101 so that the arcuate central section 127 leads the uphole section 126 and downhole section 128 with respect to the cutting direction 106. As a result, the leading surface 122 of each blade 120 is convexly curved and trailing surface 123 is concavely curved when moving axially along axis 105 of tool body 101.

Referring now to FIGS. 4-6, formation facing surface 121 of each blade 120 is disposed at an outer radius $R_{121}$ measured radially from a reamer axis 105' that is parallel and radially offset from the central axis 105 (see e.g., FIG. 6). In particular, in some embodiments (e.g., such as in the embodiment of FIG. 6), the reamer axis 105' is radially shifted toward the first side 103 (and thus the reaming blades 110) from the central axis 105. Blades 120 taper or decline radially inward when moving from arcuate central section 127 toward uphole end 120*a* and downhole end 120*b*. Thus, radius $R_{121}$ of formation facing surface 121 decreases from a relative maximum at arcuate central section 127 along each of the uphole section 126 and downhole section 128 toward uphole end 120*a* and downhole end 120*b*, respectively. For purposes of clarity and further explanation, the maximum radius $R_{121}$ of formation facing surface 121 of each blade 120 (e.g., the maximum radius within the uphole section 126, downhole section 128 and along the arcuate central section 127) is referred to herein as $R_{121\ max}$.

In some embodiments (e.g., such as the embodiments of FIGS. 4 and 5), the stabilizing blades 120 do not include any cutter elements 119 (see e.g., FIGS. 2 and 3). However, in some embodiments, one or more of the stabilizing blades 120 may include one or more cutter elements 119, but, such cutter elements 119 mounted to blades 120 may not extend radially beyond radii $R_{121\ max}$ of blades 120.

Referring again to FIG. 6, the transition between the formation facing surface 121 and leading surface 122, and between the formation facing surface 111 and trailing surface 123 of each blade 120 may be convexly curved or radiused when moving along the circumferential perimeter of reaming tool 100. In particular, in some embodiments, the radius $R_{122}$ of the transition between the leading surface 122 and the formation facing surface 121 may be larger than the radius $R_{123}$ of the transition between the formation facing surface 121 and the trailing surface 123. In some embodiments, the radius $R_{123}$ may be less than the radius $R_{122}$. For instance, in some embodiments, the radius $R_{123}$ may be about one third (⅓) of the radius $R_{122}$. In some embodiments, the radius $R_{122}$ may be substantially equal to the radius $R_{123}$. In some embodiments, the radius $R_{122}$ may be greater than or equal to about 0.3 inches (in), and the radius $R_{123}$ may less than or equal to about 0.3 in. Thus, in some embodiments, for each blade 120, the transition between the leading surface 122 and the formation facing surface 121 may be more gradual than the transition between the trailing surface 123 and the formation facing surface 121. Without being limited to this or any other theory, a less abrupt transition between the formation facing surface 121 and the leading surface 122 (e.g., radius $R_{122}$) may allow for more gradual contact initiation between the blade 120 and the borehole wall 11 (or casing 14) as reaming tool 100 is rotated, so that stresses imparted to the reaming tool 100 (e.g., via blades 120) may be reduced during operations.

In addition, referring still to FIG. 6, in some embodiments, the maximum radius $R_{111\ max}$ of the blades 110 may be generally greater than the maximum radius $R_{121\ max}$ of the blades 120. As previously described, the radius $R_{111}$ (including $R_{111\ max}$) may be measured from the central axis 105 whereas the radius $R_{121}$ (including $R_{121\ max}$) may be measured from the reamer axis 105' which is parallel and radially offset from the central axis 105. Thus, the reaming tool 100 may be eccentric about the central axis 105 so as to allow the reaming tool 100 to pass through a diameter (e.g., pass through diameter $D_{100}$ described in more detail below) that is smaller than its reaming diameter (e.g., diameter $D_{110}$ described in more detail below).

Referring again to FIGS. 2-5, each of the blades 110 has an axial length $L_{110}$ measured axially between the ends 110*a*, 110*b*, and each of the blades 120 has an axial length $L_{120}$ measured axially between ends 120*a*, 120*b*. In some embodiment, the axial length $L_{110}$ of the blades 110 is different from the axial length $L_{120}$ of the blades 120. For instance, in some embodiments (e.g., such as in the embodiment of FIGS. 2-5), the axial length $L_{110}$ of the blades 110 is greater than the axial length $L_{120}$ of the blades 120. Without being limited to this or any other theory, a reduced length $L_{120}$ of the blades 120 relative to the length $L_{110}$ of the blades 110 may reduce a surface area contact of the blades 120 with the casing 14 and/or the borehole wall 11 (see e.g., FIG. 1) during operations, which may reduce the rate of wear to the blades 120 during operations and thereby increase the operational life of reaming tool 100.

Figure 8:
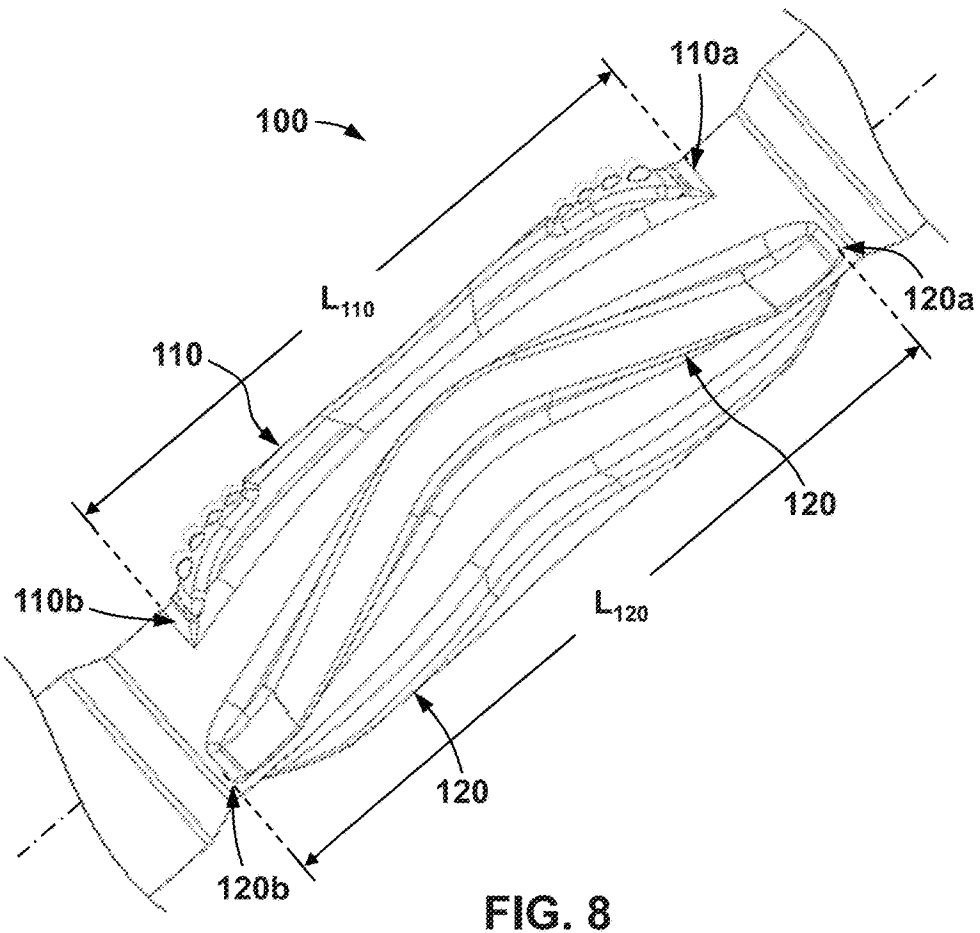
FIGS. 7 and 8 are side views of a reaming tool for use within the system of FIG. 1 according to some embodiments.
Figure 7:
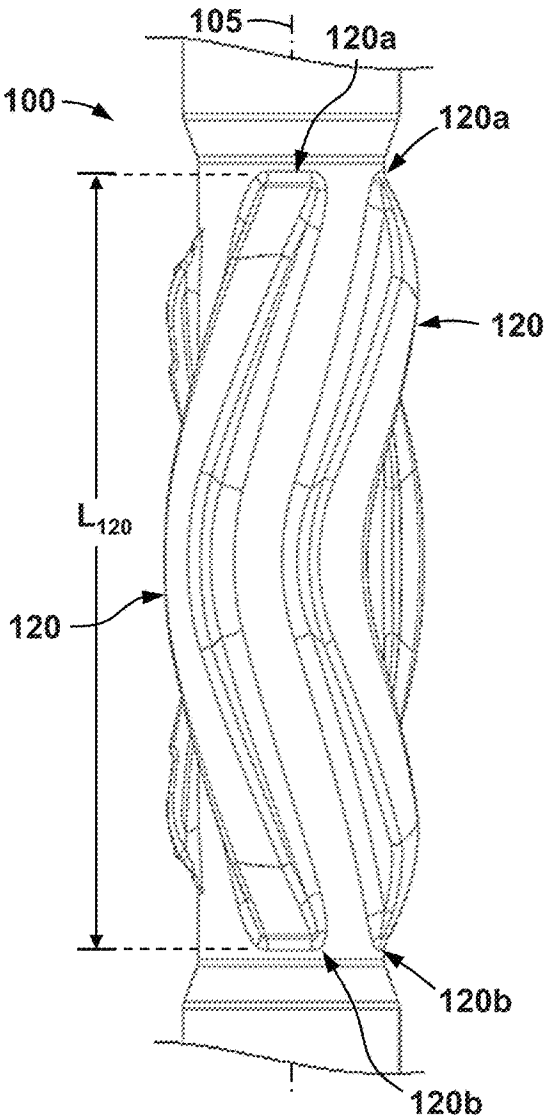

Conversely, as shown in FIGS. 7 and 8, in some embodiments, the axial length $L_{110}$ of the blades 110 may be less than the axial length $L_{120}$ of the blades 120. Without being limited to this or any other theory, a longer length $L_{120}$ of the blades 120 relative to the length $L_{110}$ of the blades 110 may increase a stability of the tool 100 within the casing 14 and/or borehole by increasing surface area contact between the blades 120 and the casing 14 and/or borehole wall 11 (see e.g., FIG. 1).

Referring again to FIGS. 2-6, as previously described, the radii $R_{111}$, $R_{121}$ of the formation facing surfaces 111, 121 of blades 110, 120, respectively, taper radially inward toward tubular body 101 at both the uphole ends 110*a*, 120*a* and downhole ends 110*b*, 120*b*, respectively. In some embodiments, the radii $R_{111}$, $R_{121}$ may taper at different rates from one another for the blades 110, 120. In particular, in some embodiments, the radii $R_{111}$ of the blades 110 may taper at a greater rate or slope than the radii $R_{121}$ of blades 120. Accordingly, in some embodiments, the tapering of the blades 110 at the ends 110*a*, 110*b* may be faster or more abrupt than the tapering of the blades 120 at the ends 120*a*, 120*b*. In some embodiments, the blades 110 may taper along a radius (not specifically shown) that is equal to about 50% of the total reaming diameter (e.g., diameter $D_{110}$ described below and shown in FIG. 6) of the reaming tool 100 and the blades 120 may taper along a radius (not specifically shown) that is equal to about 100% to about 150% of the total reaming diameter (e.g., diameter $D_{110}$) of the reaming tool 100.

Referring still to FIGS. 2-6, the shape, size, a positioning, and arrangement of the blades 110, 120 may be configured to promote channeling or flowing of fluids and cuttings axially along tool body 101 toward uphole end 30*a* of drillstring 30 (see e.g., FIG. 1). In particular, the chevron or boomerang shape of the blades 110, 120, previously described above may form or define corresponding chevron or boomerang shaped axial channels or recesses 130 between circumferentially adjacent blades 110, 120. Without being limited to this or any other theory, the chevron or boomerang shaped axial channels or recesses 130 circumferentially disposed between blades 110, 120 may sweep or push fluids (as well as cuttings or other solids entrained therein), uphole along the uphole sections 116, 126, toward uphole end 30*a* of drillstring 30 as reaming tool 110 is rotated about axis 105 in cutting direction 106.

In addition, because the taper or slope of the ends 120*a*, 120*b* of stabilizing blades 120 is more gradual than the taper or sloe of the ends 110*a*, 110*b* of the reaming blades 110, fluid flowing along channels 130 may experience a greater flowable flow area proximate the ends 120*a*, 120*b*. As a result, reaming tool 100 may present a reduced flow construction for fluids within the borehole 11 during operations.

Referring again to FIG. 6, remaining tool 100 has a minimum pass through diameter $D_{100}$, which represents the minimum diameter hole or bore through which uphole reaming tool 100 can be tripped. The pass through diameter $D_{100}$ may be generally less than or equal to the inner diameter $D_{14}$ of casing 14, so that the reaming tool 100 may be passed through casing 14 during operations.

When reaming tool 100 is rotated in cutting direction 106 about axis 105, it cuts or reams a hole (e.g., via the remaining blades 110) to a reaming diameter $D_{110}$. Reaming diameter $D_{110}$ is greater than pass through diameter $D_{100}$, thereby allowing reaming tool 100 to ream borehole 11 to diameter $D_{110}$ that is greater than the pass through diameter $D_{100}$. In embodiments, reaming diameter $D_{110}$ is preferably greater than pass through diameter $D_{100}$; more preferably reaming diameter $D_{110}$ is greater than pass through diameter $D_{100}$, and less than 112% of pass through diameter $D_{100}$; and even more preferably reaming diameter $D_{110}$ is greater than pass through diameter $D_{100}$ and less than 105% of pass through diameter $D_{100}$.

Figure 9:
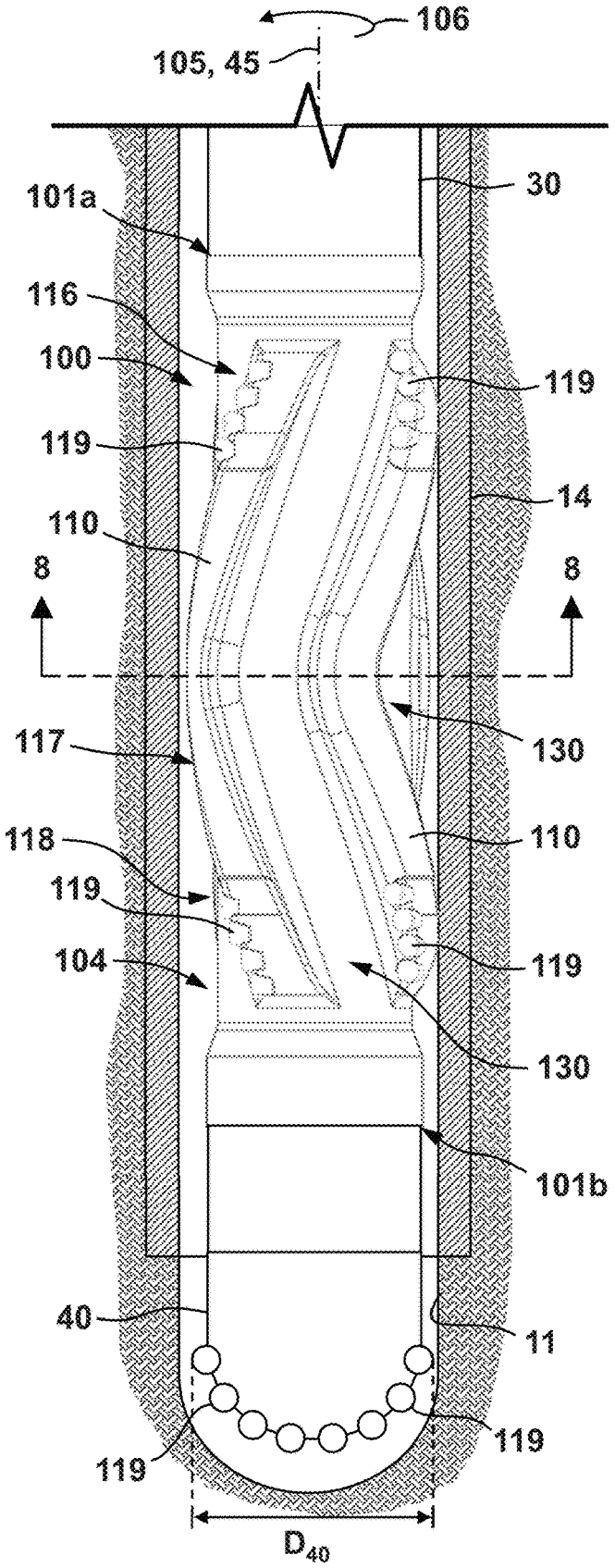
FIG. 9 is a side, partial cross-sectional view of the reaming tool and a drill bit of the drilling system of FIG. 1 according to some embodiments.

Referring now to FIGS. 6 and 9, drill bit 40 is connected to downhole end 101*b* of tool body 101 and has a central axis 45 coaxially aligned with axis 105. During drilling operations, bit 40 is rotated about axis 45 in cutting direction 106. As will be described in more detail below, in some embodiments, bit 40 is a fixed cutter bit including a plurality of blades extending that support a plurality of cutter elements 119 thereon. The cutter elements 119 may be generally the same or similar to the cutter elements 119 disposed on blades 110 as previously described above. Bit 40 has a maximum or full gage diameter $D_{40}$ defined by the radially outermost reaches of the blades and cutter elements 119. In some embodiments, full gage diameter $D_{40}$ of bit 40 is greater than the pass through diameter $D_{100}$ of reaming tool 100 and less than the reaming diameter $D_{110}$. In addition, the full gage diameter D40 is less than (or equal to) the inner diameter $D_{14}$ of casing 14.

Referring now to FIG. 9, during drilling operations, reaming tool 100 and drill bit 40 are rotated in cutting direction 106. With WOB applied, bit 40 engages and cuts the formation. As chips of the formation are broken off and transported to the surface with drilling mud, bit 40 advances along a predetermined trajectory to lengthen borehole 11. During the initial stages of drilling immediately below casing 14, tool 100 is disposed within casing 14 and is rotated with string 30 to rotate bit 40. With most conventional eccentric reamers, rotation of the reamer within casing (e.g., casing 14) is generally discouraged as the reamer may undesirably cut and damage the casing, potentially comprising the integrity of the well. In particular, most eccentric reamers are sized such that they can be advanced axially through the casing 14, and then ream the borehole to a diameter greater than the diameter of the casing 14. To maximize the diameter of the reamed borehole, conventional reamers are typically sized as large as possible while being able to be advanced through the casing. Consequently, when such an eccentric reamer is rotated within the casing, it may ream the inside of the casing to a diameter greater than the inner diameter of the casing itself (e.g., diameter $D_{14}$ of casing 14), thereby potentially damaging the casing. However, in embodiments described herein, reaming tool 100 (e.g., in particular blades 110, 120) is configured such that it may be rotated within casing 14 without posing a significant risk of damage to casing 14.

Figure 10:
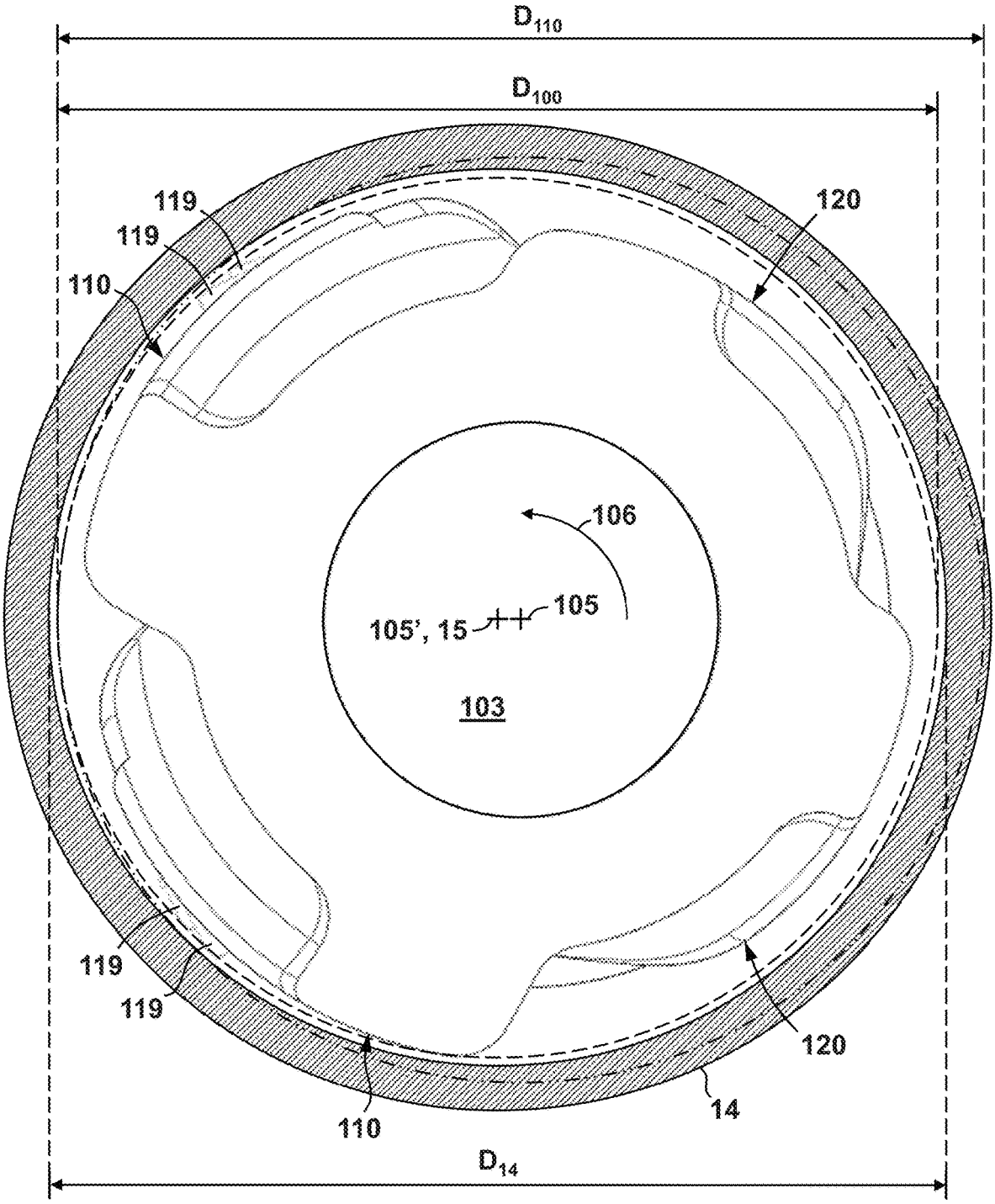
FIG. 10 is a cross-sectional view taken along section 8-8 in FIG. 9 according to some embodiments.

As best shown in FIG. 10, blades 110, 120 are sized as large as possible while still being able to pass through casing 14. Specifically, as previously described, the pass through diameter $D_{100}$ is less than or equal to the inner diameter $D_{14}$ of casing 14. In addition, due to the eccentricity of blades 110, 120 as previously described above, when reaming tool 100 is disposed in casing 14, central axis 105 of tool 100 is radially offset from central axis 15 of casing 14 and axis 105' is coaxially aligned with axis 15 of casing 14. As previously described, if reaming tool 100 is permitted to rotate in cutting direction 106 about tool axis 105 while positioned within the casing 14, cutter elements 119 on reaming blades 110 will ream the inside of casing 14 to diameter $D_{110}$. However, when positioned within casing 14, reaming tool 100 does not rotate about axis 105. Rather, within casing 14, reaming tool 100 is forced to rotate about the reamer axis 105'. More specifically, engagement of the smooth formation facing surfaces 111, 121 disposed at radii $R_{111\ max}$, $R_{121\ max}$ of blades 110, 120, respectively, with the smooth inner cylindrical surface of casing 14 continuously forces reamer sections 110, 130 to rotate about axes 15, 105' and prevents cutter elements 119 from cutting into casing 14. Because eccentric reamer sections 110, 130 are forced to rotate about reamer axis 105' within the rotational diameter of reaming tool 100 within casing 14 is equal to pass through diameters $D_{100}$, thereby enabling reaming tool 100 to pass axially through casing 14 while being rotated and without reaming or damaging casing 14.

Referring now to FIGS. 1, 9, and 10, once bit 40 has sufficiently advanced within borehole 11, reaming tool 100 exits the lower end of casing 14. Once reaming tool 100 is clear of casing 14, formation facing surfaces 111, 121 on blades 110, 120, respectively, no longer slidingly engage the smooth cylindrical inner surface of casing 14, and thus, reaming tool 100 is no longer forced to rotate about the reamer axis 105'. Rather, once reaming tool 100 is clear of casing 14, blades 110, 120 rotate about tool axis 105, thereby enabling reaming blades 110 (e.g., via cutter elements 119) to ream borehole 11 to diameter $D_{110}$, which is greater than diameters $D_{14}$, $D_{100}$ as previously described.

When drilling new sections of borehole 11 (i.e., during advancement of tool 100 through borehole 11), downhole section 118 of each blade 110 leads uphole section 116 and functions as the primary reamer, whereas when tripping reaming tool 100 out of borehole 11 (i.e., during retraction of reaming tool 100 from borehole 11), uphole section 116 of each blade 110 leads downhole reamer section 118 and functions as the primary reamer. Cutter elements 119 of downhole section 118 are disposed proximal lower ends 110*b* of blades 110, and extend to progressively increasing radii moving axially from downhole ends 110*b* toward uphole ends 110*a*; and cutter elements 119 of uphole section 116 are disposed proximal uphole ends 110*a* of blades 110, and extend to progressively increasing radii moving axially from uphole ends 110*a* toward lower ends 110*b*. Thus, when drilling new sections of borehole 11, reaming tool 100 is rotated in cutting direction 106 about axis 105 and downhole sections 118 of blades lead uphole sections 116, thereby enabling cutter elements 119 mounted to downhole sections 118 of blades 110 to progressively increase the diameter of borehole 11 to reaming diameter $D_{110}$ as reaming tool 100 advances through borehole 11. Conversely, when tripping reaming tool 100 out of borehole 11, reaming tool 100 is rotated in cutting direction 106 about axis 105 and uphole sections 116 of blades 110 leads downhole sections 118, thereby enabling cutter elements 119 mounted to downhole sections 119 of blades 110 to progressively increase the diameter of borehole 11 to reamer diameter $D_{110}$ as reaming tool 100 advances through borehole 11.

In the manner described, reaming tool 100 and particularly blades 110, 120 can be rotated within casing 14 without cutting or damaging casing 14 and ream borehole 11 to a diameter $D_{110}$ that is greater than the inner diameter $D_{14}$ of casing. Within casing 14, blades 110, 120 are forced to rotate about axis 15 of casing 14, however, once reaming tool 100 is clear of casing 14, blades 110, 120 rotate about axis 105 of reaming tool 100 so that blades 110 (e.g., in particular the cutter elements 119 on blades 110) can ream borehole 11 while drilling new sections of borehole 11 and while tripping reaming tool 100 out of borehole 11. Furthermore, reaming tool 100 can be used in connection with a drill bit (e.g., bit 40), such as a drill bit that is being rotated exclusively by a downhole mud motor. Specifically, because the pass through diameter $D_{100}$ of the reaming tool 100 is slightly less than the diameter of the drill bit (e.g., diameter $D_{40}$ of drill bit 40)

which is equal to or slightly less than the casing diameter (e.g., diameter $D_{14}$), reaming tool 100 can pass through a borehole (e.g., borehole 11) that is being drilled by the bit (e.g., bit 40) without also rotating therein.

In the particular embodiments described above, drill bit 40 is a fixed cutter bit; however, in other embodiments the reamer sections (e.g., reamer sections 110, 130) can be used in connection with different types of drill bit such as rolling cone drill bits. In addition, in the embodiment of reaming tool 100 previously shown and described, blades 110, 120 are disposed within a recess 104 positioned along the outer surface 102 of tool body 101. However, in other embodiments, no such recess 104 may be included. Further, in other embodiments, the recess 104 may be included along the outer surface 102 of the body 101, but the recess 104 may not be equidistant from the ends 101*a*, 101*b*.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A reaming tool for reaming a borehole, the tool comprising:

a tubular body having a central axis; and a plurality of blades circumferentially spaced along the tubular body, wherein each of the plurality of blades comprises:

an uphole section that extends in a first helical direction about the central axis along the tubular body;

a downhole section that extends in a second helical direction about the central axis along the tubular body, wherein the second helical direction is opposite the first helical direction; and an arcuate central section that continuously extends from the uphole section to the downhole section along the tubular body, wherein the plurality of blades are eccentric about the central axis such that the reaming tool is configured to pass axially through a first diameter and is configured to ream a borehole to a second diameter that is greater than the first diameter when the tool is rotated about the central axis in a cutting direction, and wherein the plurality of blades comprises:

one or more first blades that have a first axial length extending from an uphole end to a downhole end of the one or more first blades; and one or more second blades that have a second axial length extending from an uphole end to a downhole end of the one or more second blades, wherein the first axial length is different from the second axial length.

2. The reaming tool of claim 1, wherein the one or more first blades extend radially to a first maximum radius from the central axis, wherein the one or more second blades extend radially to a second maximum radius from a reamer axis that is parallel to and radially offset from the central axis, and wherein the first maximum radius is greater than the second maximum radius.

3. The reaming tool of claim 1, wherein the one or more first blades comprise a cutter element and wherein the one or more second blades do not comprise cutter elements.

4. The reaming tool of claim 1, wherein the first axial length is greater than the second axial length.

5. The reaming tool of claim 1, wherein the first axial length is less than the second axial length.

6. The reaming tool of claim 1, wherein an outer surface of each of the first blades tapers toward the tubular body at an uphole end and a downhole end at a first rate, wherein an outer surface of each of the second blades tapers toward the tubular body at an uphole end and a downhole end at a second rate, and wherein the first rate is greater than the second rate.

7. The reaming tool of claim 1, wherein each of the plurality of blades comprises a leading edge, a trailing edge such that the leading edge leads the trailing edge when the tool is rotated about the central axis in the cutting direction, and a formation facing surface extending between the leading surface and the trailing surface, wherein a transition between the leading edge and the formation facing surface is convexly curved to a first radius, wherein a transition between the trailing edge and the formation facing surface is convexly curved to a second radius, and wherein the first radius is larger than the second radius.

8. A system for drilling a borehole in an earthen formation, the system comprising:

a drillstring having a central axis, an uphole end, and a downhole end;

a drill bit disposed at the downhole end of the drillstring coaxially aligned with the drillstring, wherein the drill bit is configured to rotate about the central axis in a cutting direction to drill the borehole; and a reaming tool coupled to the drillstring such that the reaming tool is positioned between the drill bit and the uphole end of the drillstring along the central axis, wherein the reaming tool comprises:

a tubular body; and a plurality of blades circumferentially spaced along the tubular body, wherein each of the plurality of blades comprises:

an uphole section that extends in a first helical direction about the central axis along the tubular body;

a downhole section that extends in a second helical direction about the central axis along the tubular body, wherein the second helical direction is opposite the first helical direction; and an arcuate central section that continuously extends from the uphole section to the downhole section along the tubular body, wherein the plurality of blades are eccentric about the central axis such that the reaming tool is configured to pass axially through a first diameter and is configured to ream a borehole to a second diameter that is greater than the first diameter when the reaming tool is rotated about the central axis in a cutting direction, wherein the plurality of blades of the reaming tool comprises:

one or more first blades on a first radial side of the reaming tool; and one or more second blades on a second radial side of the reaming tool that is radially opposite from the first radial side, wherein an outer surface of each of the first blades tapers toward the tubular body at an uphole end and a downhole end at a first rate, wherein an outer surface of each of the second blades tapers toward the tubular body at an uphole end and a downhole end at a second rate, and wherein the first rate is greater than the second rate.

9. The system of claim 8, wherein the one or more first blades extend radially to a first maximum radius, wherein the one or more second blades that extend radially to a second maximum radius from a reamer axis that is parallel to and radially offset from the central axis, and wherein the first maximum radius is greater than second maximum radius.

10. The system of claim 8, wherein the one or more first blades comprise one or more cutter elements, and the one or more second blades do not comprise cutter elements.

11. The system of claim 8, wherein the one or more first blades have a first axial length extending from an uphole end to a downhole end of the one or more first blades, wherein the one or more second blades have a second axial length extending from an uphole end to a downhole end of the one or more second blades, and wherein the first axial length is different from the second axial length.

12. The system of claim 11, wherein the first axial length is greater than the second axial length.

13. The system of claim 11, wherein the first axial length is less than the second axial length.

14. The system of claim 8, wherein each of the plurality of blades comprises a leading edge, a trailing edge such that the leading edge leads the trailing edge when the tool is rotated about the central axis in the cutting direction, and a formation facing surface extending between the leading surface and the trailing surface, wherein a transition between the leading edge and the formation facing surface is convexly curved to a first radius, wherein a transition between the trailing edge and the formation facing surface is convex curved to a second radius, and wherein the first radius is larger than the second radius.

15. A method for drilling a borehole, the method comprising:

(a) coupling a drill bit to a lower end of a drillstring;

(b) coupling a reaming tool to the drillstring between the drill bit and an uphole end of the drillstring, wherein the reaming tool comprises:

a tubular body having a central axis; and a plurality of blades circumferentially spaced along the tubular body, wherein each of the plurality of blades comprises:

an uphole section that extends in a first helical direction about the central axis along the tubular body;

a downhole section that extends in a second helical direction about the central axis along the tubular body, wherein the second helical direction is opposite the first helical direction; and an arcuate central section that continuously extends from the uphole section to the downhole section along the tubular body, wherein the plurality of blades define a first outer diameter for the reaming tool;

wherein the plurality of blades comprises:

one or more first blades that have a first axial length extending from an uphole end to a downhole end of the one or more first blades, and wherein an outer surface of each of the one or more first blades tapers toward the tubular body at the uphole end and the downhole end of the one or more first blades at a first rate; and one or more second blades that have a second axial length extending from an uphole end to a downhole end of the one or more second blades, wherein an outer surface of each of the one or more second blades tapers toward the tubular body at the uphole end and the downhole end of the one or more second blades at a second rate, wherein the first axial length is different from the second axial length and the first rate is greater than the second rate;

(c) lowering the reaming tool through a casing having an inner diameter that is greater than or equal to the first outer diameter of the reaming tool;

(d) rotating the drill bit and the remaining tool in a cutting direction about the central axis after (c); and (e) reaming the borehole with the plurality of blades of the reaming tool during (c) to a reaming diameter that is greater than the first outer diameter of the reaming tool and the inner diameter of the casing.

16. The method of claim 15, further comprising:

(f) offsetting a central axis of the tubular body from a central axis of the casing during (c).

17. The method of claim 15, further wherein (d) comprises, for each of the plurality of blades, leading the uphole section and the downhole section with the arcuate central section with respect to the cutting direction.

* * * * *